US005847501A

United States Patent [19]

Ahn

[11] Patent Number: 5,847,501

[45] Date of Patent: Dec. 8, 1998

[54] ELECTRON GUNS FOR COLOR PICTURE TUBE WITH ELECTROSTATIC FOCUSING LENSES FOR OPERATING IN VERTICAL AND HORIZONTAL DIRECTIONS

[76] Inventor: Sung Gi Ahn, 265-19, Kongdan 2-Dong, Kumi, Kyungsangbook-Do, Rep. of Korea

[21] Appl. No.: 740,998

[22] Filed: Nov. 5, 1996

Related U.S. Application Data

[62] Division of Ser. No. 355,673, Dec. 14, 1994, abandoned.

[30] Foreign Application Priority Data

Dec. 14, 1993 [KR] Rep. of Korea ..... 5-27651

[51] Int. Cl.[6] ..... H01J 29/51

[52] U.S. Cl. ..... 313/414; 313/412; 313/413; 313/449

[58] Field of Search ..... 313/414, 412, 313/413, 449; 315/14, 15, 382

[56] References Cited

U.S. PATENT DOCUMENTS

| | | | |
|---|---|---|---|
| Re. 34,339 | 8/1993 | Osakabe | 315/14 |
| 4,208,610 | 6/1980 | Schwartz | 313/414 |
| 5,023,508 | 6/1991 | Park | 313/412 |
| 5,386,178 | 1/1995 | Son et al. | 313/414 |

FOREIGN PATENT DOCUMENTS

| | | | |
|---|---|---|---|
| 0081736 | 5/1985 | Japan | 313/414 |
| 2027269 | 2/1980 | United Kingdom | 313/414 |

*Primary Examiner*—Sandra L. O'Shea
*Assistant Examiner*—Jay M. Patidar

[57] ABSTRACT

In-line electron guns for color picture tube suitable for improving the resolution of the color picture tube is disclosed. In the electron guns, the beam passing openings of first and second accelerating/focusing electrodes are projected or depressed in specified directions, thus to let the focusing actions of the main electrostatic focusing lenses in the vertical direction and in the horizontal direction not only be carried out at different positions but also be differently carried out. Therefore, the electron guns not only reduce the vertical slenderness of the beam spot formed on the center of the screen but also nearly remove the hollow parts of low electron density formed above and below the core part of each beam spot formed on the edge of the screen.

4 Claims, 9 Drawing Sheets

ELECTRON GUNS FOR COLOR PICTURE TUBE WITH ELECTROSTATIC FOCUSING LENSES FOR OPERATING IN VERTICAL AND HORIZONTAL DIRECTIONS

This is a division of application Ser. No. 08/355,673, filed Dec. 14, 1994 now abandoned.

BACKGROUND OF THE INVENTION

1. Field of the Invention

The present invention relates in general to electron guns for color picture tubes and, more particularly, to a structural improvement of in-line electron guns for color picture tube for improving the resolution of the edge of a phosphor screen of the color picture tube.

2. Description of the Prior Art

FIG. 1 is a partially broken perspective view showing a structure of typical single electrostatic lens type electron guns for an in-line color picture tube. As shown in this drawing, the single electrostatic lens type electron guns include a beam forming region (BFR) comprising three electron beam sources or three cathodes 10 having their heaters (not shown) therein. The three cathodes 10 placed in the horizontal line emit their respective electron beams or R, G and B beams in accordance with heating of their heaters. The beam forming region also includes two grids, that is, first and second grids 11 and 12. The first grid 11 controls emission amounts of the three electron beams owing to potential difference between the grid 11 and the three cathodes 10, while the second grid 12 spreads the electron beams controlled by the first grid 11. The electron guns also include main electrostatic focusing lenses comprising a first accelerating/focusing electrode 13 and a second accelerating/focusing electrode 14, which electrodes 13 and 14 accelerate the three electron beams from the second grid 12 and precisely focus the electron beams on a phosphor screen (not shown) of the color picture tube.

Referring next to FIG. 2, there is shown typical multi-focusing electron guns, having an asymmetric electron beam forming region, for an in-line color picture tube. This multi-focusing electron guns improve the electron beam focusing effect in comparison with the above single electrostatic lens type electron guns. Differently from the electron guns of FIG. 1, the multi-focusing electron guns additionally includes third and fourth grids 16 and 17 between the beam forming region and the main electrostatic focusing lenses, which grids 16 and 17 are adapted for giving additional focusing effect to the electron guns and improves the electron beam focusing effect of the electron guns.

When the third and fourth grids 16 and 17 are removed from the multi-focusing electron guns of FIG. 2, the operation of the electron guns of FIG. 2 will be equal to that of the electron guns of FIG. 1. In this regard, only the operation of the multi-focusing electron guns of FIG. 2 will be described in the following description.

In operation of the multi-focusing electron guns, the electron beam sources or the cathodes 10 emit their thermions due to heat of their heaters. The thermions are controlled in their amounts of electron beams by the first grid 11 while passing through the beam passing openings 11*a* of the first plate type grid 11. The electron beams from the first grid 11 pass through their associated beam passing openings 12*a* of the second grid 12. The electron beams from the second grid 12 in turn pass through their associated beam passing openings 16*a* of the third grid 16. Here, the third grid 16 acts to precisely focus the electron beams on shadow mask holes.

Thereafter, the electron beams from the third grid 16 pass through their associated beam passing openings 17*a* of the fourth grid 17. Here, the fourth grid 17 acts to accelerate the electron beams from the third grid 16.

The electron beams from the fourth grid 17 in turn pass through their associated beam passing openings 13*a* and 14*a* of the first and second accelerating/focusing electrodes 13 and 14. In the multi-focusing electron guns, the beam passing openings 11*a*, 12*a*, 16*a*, 17*a*, 13*a* and 14*a* of the first to fourth grids and of the two accelerating/focusing electrodes nearly become ideal circular cylinders. In addition, the main electrostatic focusing lenses (25, see FIG. 5A) formed by the first and second accelerating/focusing electrodes 13 and 14 are axial symmetric circular lenses. In this regard, when the electron guns are applied with electric power, the electron beams passing through the openings 11*a*, 12*a*, 16*a*, 17*a*, 13*a* and 14*a* are focused in the rotative symmetry type on the screen in accordance with Lagrange's refraction law.

The electron beams which are emitted, in the form of circular beams, from the electron guns are not affected by the deflection yoke (not shown) provided about the neck of the color picture tube, so that the electron beams 26 (see FIG. 5A) are circularly focused on the phosphor screen (not shown) of the color picture tube, thus to form small circular beam spots on the phosphor screen.

In the typical multi-focusing electron guns, the electron beams are scanned all over the screen by the deflection magnetic field of the deflection yoke, thus to form the picture on the screen. The deflection magnetic field of the deflection yoke should not only deflect the electron beams, emitted from the electron guns, all over the screen but also converge the electron beams into desired points of the screen. In order to achieve the above object, the typical electron guns are provided with a self convergence function. The self convergence achieves the above object by letting the electron guns emit the electron beams in a horizontal in-line direction and by letting the deflection yoke generate a nonuniform deflection magnetic field whose intensity is different between the center of the screen and the edge of the screen.

With the self convergence magnetic field, the electron beams or R, G and B electron beams are automatically converged all over the screen. Such a self convergence magnetic field includes a pincushion magnetic field or a horizontal deflection magnetic field (X—X direction) shown in FIG. 3A and a barrel magnetic field or a vertical deflection magnetic field (Y—Y direction) shown in FIG. 3B. As shown in FIGS. 4A and 4B, either the pincushion magnetic field or the barrel magnetic field includes a bipolar component and a tetrapolar component. The electron beams from the electron guns are thus mainly deflected in the direction of the straight arrows of FIGS. 4A and 4B by the bipolar component, while the electron beams are also minutely affected by the magnetic field in the directions of the curved arrows of FIGS. 4A and 4B by the tetrapolar component. In this regard, the electron beams are affected by the action of diffusing magnetic field lens in the horizontal direction and affected by the action of converging magnetic field lens in the vertical direction.

In FIGS. 3A to 4B, the reference numerals 8 and 9 denote electron beam and beam spot respectively.

FIGS. 5A and 5B are views showing optical systems representing deformation of shape of the beam spot of a color picture tube having the typical electron guns. As shown in these drawings, the horizontal section electron beams 21 and the vertical section electron beams 22, which beams 21 and 22 were emitted from the cathodes 10, are focused on the screen by a cathode lens 23, a pre-focus lens 24 and a main electrostatic focusing lens 25. At this time, at the center of the screen, the vertical converging action is equal to the horizontal converging action, so that the vertical electron beams 26 and the horizontal electron beams 27 are nearly focused on the same point of the center of the screen. However, at the edge of the screen, which edge is strongly affected by the deflection magnetic field of the deflection yoke, the vertical electron beams 26 are strongly converged by a vertical converging magnetic field lens 28, thus to be over-focused, while the horizontal electron beams 27 are strongly diffused by a horizontal diffusing magnetic field lens 29, thus to be under-focused. Therefore, the resolution of the edge of the screen is deteriorated.

In order to overcome the deterioration of the resolution at the edge of the screen due to the deflection magnetic field of the deflection yoke, an asymmetric pre-focus lens 24*a* for letting the beam diffusing actions of the main electrostatic focusing lens 25 in the vertical direction and in the horizontal direction be different from each other may be added to the electron guns as shown in FIG. 5B. In addition, a front auxiliary focusing lens 25*a* may be added to the electron guns as shown in FIG. 5B, thus to change the incident angles of the electron beams for the main electrostatic focusing lens 25. Therefore, the traces of the electron beams, after passing through the main electrostatic focusing lens 25, in the vertical direction and in the horizontal direction differ from each other, so that the deterioration of the resolution at the edge of the screen due to the deflection magnetic field of the deflection yoke will be somewhat overcome.

In the color picture tube, the horizontal slenderness of the electron beams due to the strong vertical focusing strength of the nonuniform deflection magnetic field is most prominent at the edge of the screen since the intensity of the nonuniform magnetic field is most intensified at the edge of the screen. In addition, the distance difference between the trace of the focus of the electron beams 8 and the screen is largest at the edge of the screen. Therefore, in each of the beam spots 9 formed on the edge of the screen, the core part 9*a* of each beam spot 9 becomes slender, while the hollow part 9*b* of each beam spot 9 formed above and below the core part 9*a* of each beam spot 9, which hollow part 9*b* has a low electron density, enlarges as shown in FIGS. 6A and 6B, thus to prominently reduces the resolution of the screen.

In order to remove the slender core part 9*a* as well as the hollow parts 9*b* formed above and below the slender core part 9*a* of each beam spot 9 formed on the edge of the screen, the asymmetric pre-focus lens 24*a* for previously horizontally slenderizing the electron beams 8, which beams 8 will be received by the main electrostatic focusing lens 25, is added to the electron guns. In addition, three horizontal slender beam passing openings 12*b* are formed in the second grid 12. With the asymmetric pre-focus lens 24*a* and the openings 12*b* of the second grid 12, the electron beams 8 which are received in a deflection region is vertically slenderized by letting the electron beams 8 from the asymmetric pre-focus lens 24*a* be transmitted through the axial symmetric circular lens of the main electrostatic focusing lens 25.

However, the above method can not completely remove the hollow parts 9*b* of the beam spots 9 corresponding to the distance difference between the trace of the focus of the electron beams 8 and the screen at the edge of the screen. This method also causes vertical slenderness of the electron beam spots at the center of the screen.

FIG. 6A shows shapes of beam spots 9 formed on the entire screen by electron guns having circular axial asymmetric beam passing openings. As shown in this drawing, the beam spot 9 formed on the center of the screen affected by no nonuniform deflection magnetic field comprises only the circular core part 9*a*. However, each beam spot 9 formed on the edge of the screen are strongly deflected by the nonuniform deflection magnetic field, so that the core part 9*a* of each beam spot 9 formed on the edge of the screen becomes slender, while the hollow parts 9*b* of each beam spot 9 are wide formed above and below the slender core part 9*a*.

FIG. 6B shows shapes of beam spots 9 formed on the entire screen by electron guns having horizontal slender noncircular beam passing openings in the beam forming region. As shown in this drawing, the hollow parts 9*b* of each beam spot 9 formed above and below the core part 9*a* are somewhat removed, but not completely removed. Therefore, the typical electron guns irrespective of their types still has a problem of deterioration of the resolution of the color picture tube.

SUMMARY OF THE INVENTION

It is, therefore, an object of the present invention to provide electron guns for color picture tube in which the above problems can be overcome and which not only effectively remove the hollow parts of low electron density formed above and below the core part of each beam spot formed on the edge of a screen but also remove the vertical slenderness of the beam spot formed on the center of the screen, thus to improve the resolution of the color picture tube.

In accordance with one embodiment thereof, the present invention provides electron guns for color picture tube comprising three electron beam sources for emitting in parallel their electron beams to a phosphor screen of the color picture tube, and main lenses for focusing the electron beams on the phosphor screen, wherein the improvement comprises: main electrostatic focusing lens including a first accelerating/focusing electrode and a second accelerating/focusing electrode, the first accelerating/focusing electrode and the second accelerating/focusing electrode carrying out a vertical focusing action and a horizontal focusing action at different positions.

In accordance with another embodiment, the present invention provides electron guns for color picture tube comprising: a plurality of cathodes for emitting thermions, the cathodes being directed to a phosphor screen of the color picture tube; beam forming region including first and second grids, the first and second grids being provided with beam passing openings arranged in a horizontal line, and the second grid having horizontal slender slots for forming horizontal slender asymmetric electron beams; front auxiliary focusing lenses for changing incident angles of the electron beams for main electrostatic focusing lenses; the main electrostatic focusing lenses including a first accelerating/focusing electrode and a second accelerating/focusing electrode, the first accelerating/focusing electrode and the second accelerating/focusing electrode forming weaker focusing lenses in the vertical direction and forming stronger focusing lenses in the horizontal direction.

In accordance with a further embodiment, the present invention provides electron guns for color picture tube comprising: a plurality of cathodes for emitting thermions, the cathodes being directed to a phosphor screen of the color picture tube; beam forming region including first and second grids, the first and second grids being provided with beam passing openings arranged in a horizontal line, and the second grid having vertical slender slots for forming vertical slender asymmetric electron beams; front auxiliary focusing lenses for changing incident angles of the electron beams for main electrostatic focusing lenses; the main electrostatic focusing lenses including a first accelerating/focusing electrode and a second accelerating/focusing electrode, the first accelerating/focusing electrode and the second accelerating/focusing electrode forming weaker focusing lenses in the horizontal direction and forming stronger focusing lenses in the vertical direction.

BRIEF DESCRIPTION OF THE DRAWINGS

The above and other objects, features and other advantages of the present invention will be more clearly understood from the following detailed description taken in conjunction with the accompanying drawings, in which:

FIGS. 1 and 2 are partially broken perspective views showing structures of typical electron guns for in-line color picture tube respectively, in which:

FIG. 1 shows a structure of single electrostatic lens type electron guns;

FIG. 2 shows a structure of multi-focusing electron guns having an asymmetric electron beam forming region;

FIGS. 3A and 3B show relations between beam spot and self convergence respectively, in which:

FIG. 3A shows a pincushion magnetic field; and

FIG. 3B shows a barrel magnetic field;

FIGS. 11A to 11C are views showing optical systems representing formation of picture of the electron beams on a screen of the color picture tube having electron guns of the present invention respectively, in which:

FIG. 11A shows an optical system of the electron guns of the first embodiment;

FIG. 11B shows an optical system of the electron guns of the second embodiment; and FIG. 11C shows an optical system of the electron guns of the third embodiment.

DESCRIPTION OF THE PREFERRED EMBODIMENTS

Figure 7A:
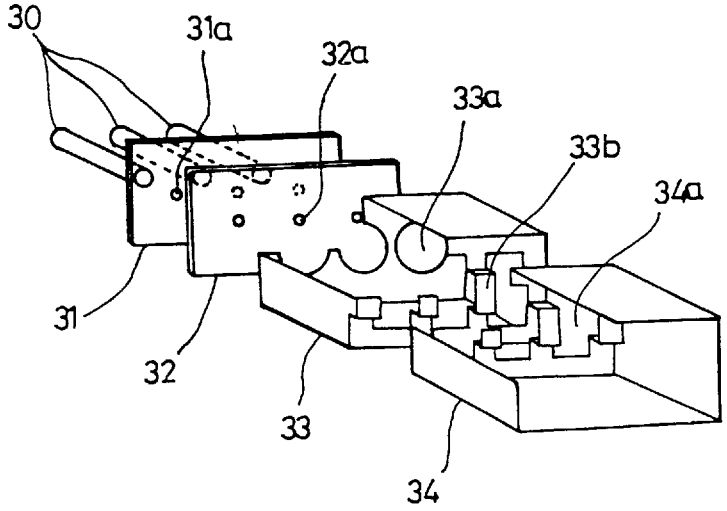
FIG. 7A is a partially broken perspective view showing a structure of electron guns for in-line color picture tube in accordance with a first embodiment of the present invention.

FIG. 7A shows electron guns for an in-line color picture tube in accordance with a first embodiment of the invention. As shown in this drawing, the electron guns include a beam forming region (BFR) comprising three electron beam sources or three cathodes 30 having their heaters (not shown). The three cathodes 30 placed in the horizontal line emit their respective electron beams or R, G and B beams in accordance with heating of their heaters. The beam forming region also includes two grids, that is, first and second grids 31 and 32. The electron guns also include main electrostatic focusing lenses comprising a first accelerating/focusing electrode 33 and a second accelerating/focusing electrode 34, which electrodes 33 and 34 not only accelerate the three electron beams from the second grid 32 but also precisely focus the electron beams on a phosphor screen (not shown) of the color picture tube.

Figure 1:
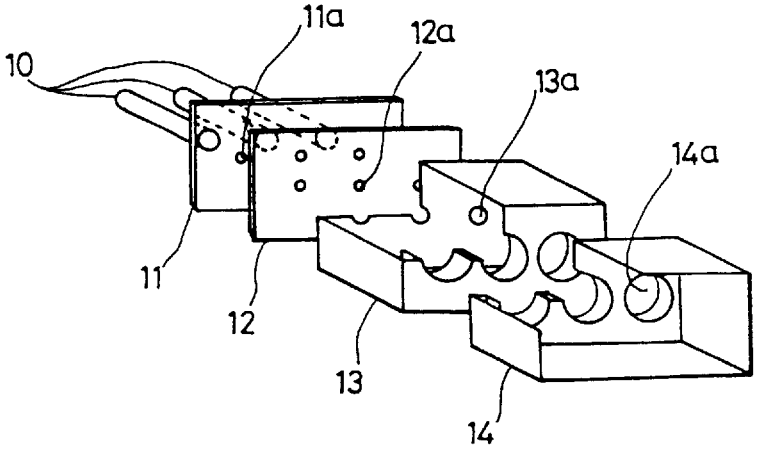
FIG. 1 CONVENTIONAL ART
Figure 2:
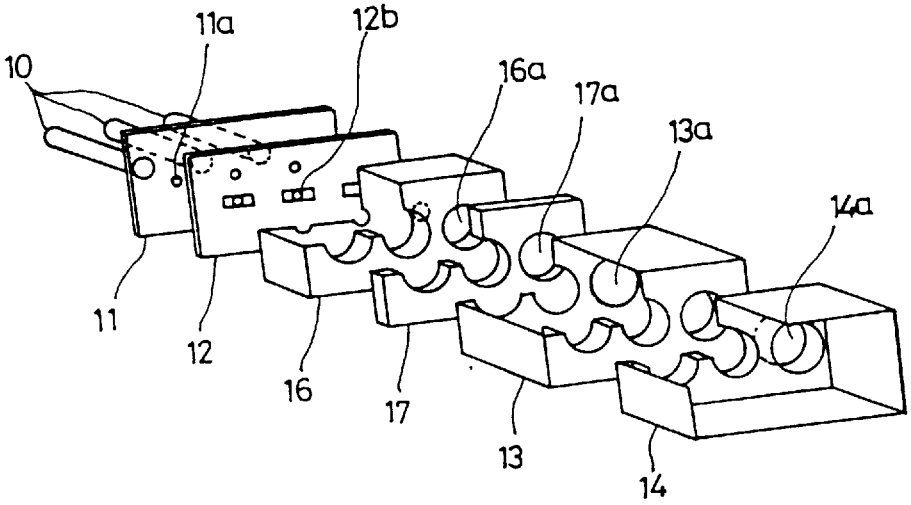
FIG. 2 CONVENTIONAL ART
Figure 3A:
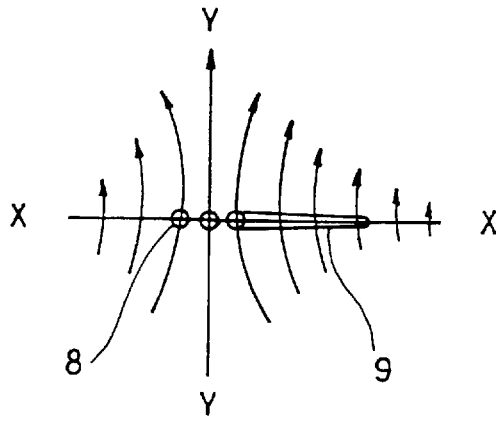
FIG. 3A CONVENTIONAL ART
Figure 3B:
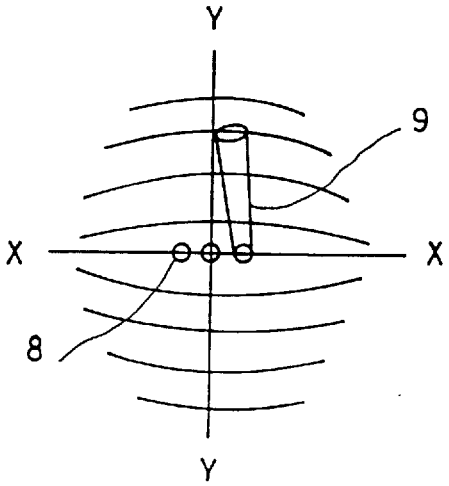
FIG. 3B CONVENTIONAL ART
Figure 4A:
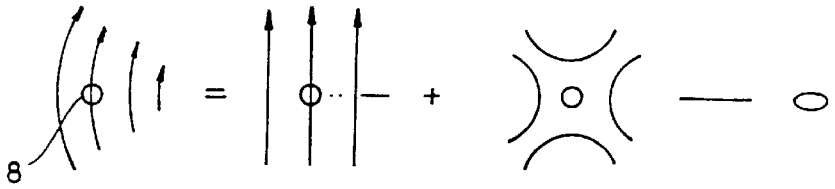
FIG.4A CONVENTIONAL ART
FIGS. 4A and 4B show the pincushion magnetic field of FIG. 3A and the barrel magnetic field of FIG. 3B respectively, showing a bipolar component and a tetrapolar component included in each of which magnetic fields.
Figure 4B:
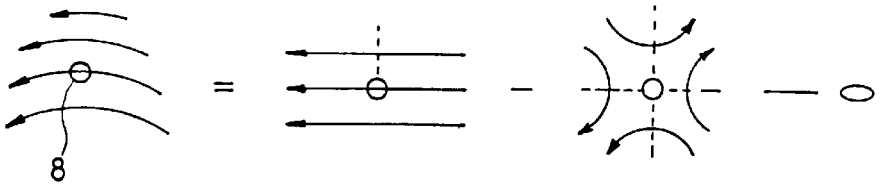
FIG.4B CONVENTIONAL ART

In the electron guns of the first embodiment, the first accelerating/focusing electrode 33 is provided with a plurality of regularly spaced projections 33*b* on one surface thereof, which one surface of the electrode 33 is opposed to the other surface provided with circular beam passing openings 33*a*. The projections 33*b* are arranged in a horizontal in-line direction and each has a width smaller than that of each beam passing opening 33*a* of the electrode 33. Each projection 33*b* protrudes at its center but flattens at its top and bottom portions. On the other hand, the second accelerating/focusing electrode 34 is provided with a plurality of regularly spaced receiving recesses 34*b* on one surface thereof, which surface of the electrode 34 is opposed to the first accelerating/focusing electrode 33. The recesses 34*b* are arranged in a horizontal in-line direction and each has a width smaller than that of each beam passing opening 34*a* of the electrode 34. Each recess 34*b* is depressed at its center but flattens at its top and bottom portions. Reference numerals 31*a* and 32*a* in FIG. 7A represents the same elements as elements 11*a* and 12*a* in prior art FIG. 1.

In the first embodiment, the projections 33*b* of the first accelerating/focusing electrode 33 are opposed to the recesses 34*b* of the second accelerating/focusing electrode 34. Therefore, even when the main electrostatic focusing lenses (see FIG. 11A) are formed on different positions in the vertical direction and in the horizontal direction and the beam forming region of the electron guns is not axially asymmetric, both the over-focus of the electron beams at the edge of the screen caused by the converging magnetic: field lens in the vertical direction of the deflection magnetic field and the under-focus of the electron beams at the edge of the screen caused by the diffusing magnetic field lens in the horizontal direction of the deflection magnetic field are overcome.

Figure 7B:
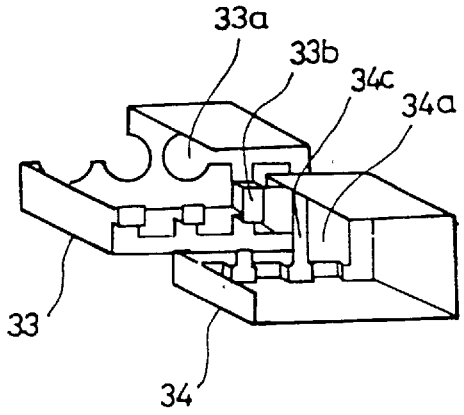
FIG. 7B is a partially broken perspective view showing another embodiment of first and second accelerating/focusing electrodes used in the electron guns of FIG. 7A.

In construction of the first accelerating/focusing electrode 33 and the second accelerating/focusing electrode 34, it should be understood that the second accelerating/focusing electrode 34 may be provided with a plurality of partitions 34*c* between the beam passing openings 34 as shown in FIG. 7B, while the first accelerating/focusing electrode 33 may be constructed in the same manner as described above. Each partition 34*c* protrudes from the surface of the electrode 34 in a direction perpendicular to the horizontal in-line direction and has a width smaller than that of each beam passing opening 34*a*.

Figure 8A:
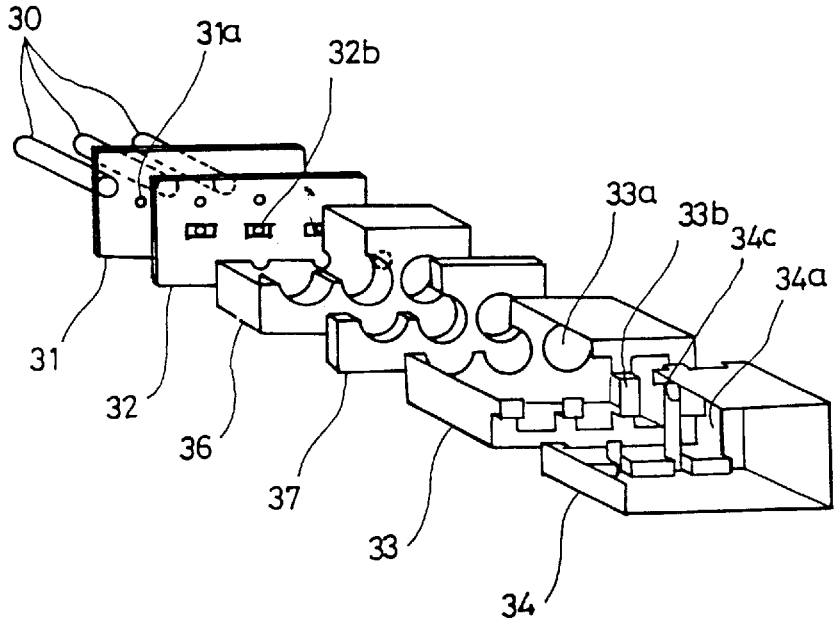
FIG. 8A is a partially broken perspective view showing a structure of electron guns for in-line color picture tube in accordance with a second embodiment of the present invention.

FIG. 8A shows electron guns for an in-line color picture tube in accordance with a second embodiment of the invention. As shown in this drawing, the electron guns include three electron beam sources or three cathodes 30 having their heaters, the first grid 31, and the second grid 32 having horizontal slender slot 32*b*. The electron guns also include front auxiliary focusing lenses comprising third and fourth grids 36 and 37. The electron guns further include main electrostatic focusing lenses comprising a first accelerating/focusing electrode 33 and a second accelerating/focusing electrode 34. The first accelerating/focusing electrode 33 and the second accelerating/focusing electrode 34 form weaker focusing lenses in the vertical direction and form stronger focusing lenses in the horizontal direction.

In the electron guns of the second embodiment, the first accelerating/focusing electrode 33 is provided with a plurality of regularly spaced projections 33*b* on one surface thereof, which surface of the electrode 33 is opposed to the other surface provided with circular beam passing openings 33*a*. The projections 33*b* are arranged in a horizontal in-line direction and each has a width smaller than that of each beam passing opening 33*a* of the electrode 33. Each projection 33*b* protrudes at its center but flattens at its top and bottom portions. On the other hand, the second accelerating/focusing electrode 34 is provided with a plurality of partitions 34*c* on one surface thereof, which surface of the electrode 34 is opposed to the first accelerating/focusing electrode 33. The partitions 34*c* protrude from the one surface between the beam passing openings 34*a* in a direction perpendicular to the horizontal in-line direction. Each partition 34*c* has a width smaller than that of each beam passing opening 34*a*.

In the second embodiment, the first accelerating/focusing electrode 33 is opposed to the second accelerating/focusing electrode 34 and their surfaces having the beam passing openings 33*a* and 34*a* are protruded and partitioned in the horizontal in-line direction by the projections 33*b* and by the partitions 34*c* respectively, either each of which projections 33*b* or each of which partitions 34*c* has the width smaller than that of each beam passing opening 33*a* or 34*a*. Therefore, the first accelerating/focusing electrode 33 and the second accelerating/focusing electrode 34 form the weaker focusing lenses in the vertical direction and form the stronger focusing lenses in the horizontal direction.

Figure 8B:
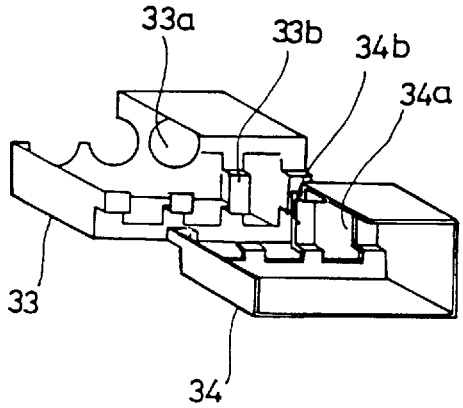
FIG. 8B is a partially broken perspective view showing another embodiment of first and second accelerating/focusing electrodes used in the electron guns of FIG. 8A.

In construction of the first accelerating/focusing electrode 33 and the second accelerating/focusing electrode 34, it should be understood that the second accelerating/focusing electrode 34 may be provided with a plurality of regularly spaced receiving recesses 34*b* on the one surface thereof as shown in FIG. 8B, which surface of the electrode 34 is opposed to the first accelerating/focusing electrode 33, while the first accelerating/focusing electrode 33 may be constructed in the same manner as described above. The recesses 34*b* are arranged in a horizontal in-line direction and each has a width smaller than that of each beam passing opening 34*a* of the electrode 34. Each recess 34*b* is depressed at its center but flattens at its top and bottom portions.

Figure 9:
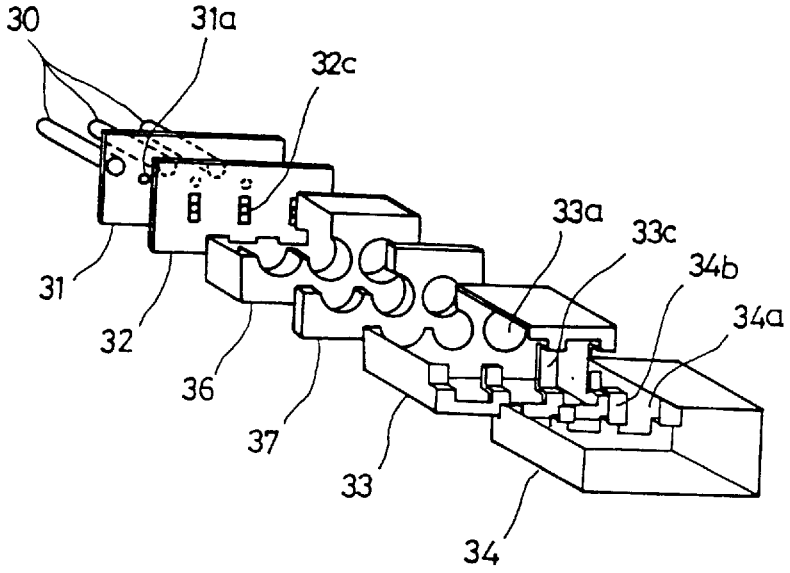
FIG. 9 is a partially broken perspective view showing a structure of electron guns for in-line color picture tube in accordance with a third embodiment of the present invention.

FIG. 9 shows electron guns for an in-line color picture tube in accordance with a third embodiment of the invention. As shown in this drawing, the electron guns include three cathodes 30, the first grid 31, and the second grid 32 having vertical slender slot 32*c*. The electron guns also include a third grid 36 and a fourth grid 37, which third grid 36 is opposed to the second grid 32. The electron guns further include main electrostatic focusing lenses comprising a first accelerating/focusing electrode 33 and a second accelerating/focusing electrode 34 in the same manner as described for the first and second embodiments.

Figure 10A:
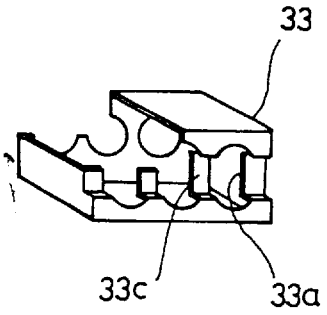
FIGS. 10A to 10C are partially broken perspective views showing other embodiments of a first accelerating/focusing electrodes used in the electron guns of FIG. 9 respectively.

As shown in FIG. 10A, the first accelerating/focusing electrode 33 of the electron guns of the third embodiment may be provided with a plurality of regularly spaced receiving recesses 33*c* on one surface thereof, which surface of the electrode 33 is opposed to the other surface having the beam passing openings 33*a*. The recesses 33*c* are arranged in a horizontal in-line direction and each has a width smaller than that of each beam passing opening 33*a* of the electrode 33. Each recess 33*c* is depressed at its center but flattens at its top and bottom portions. On the other hand, the second accelerating/focusing electrode 34 is provided with a plurality of regularly spaced receiving recesses 34*b* on one surface thereof, which surface of the electrode 34 is opposed to the first accelerating/focusing electrode 33. The recesses 34*b* are arranged in a horizontal in-line direction and each has a width smaller than that of each beam passing opening 34*a* of the electrode 34. Each recess 34*b* is depressed at its center but flattens at its top and bottom portions.

In thin embodiment, the first accelerating/focusing electrode 33 is opposed to the second accelerating/focusing electrode 34 and their surfaces having the beam passing openings 33*a* and 34*a* are recessed in the horizontal in-line direction by the recesses 33*c* and 34*b* respectively, each of which recesses 33*c* or 34*b* has the width smaller than that of each beam passing opening 33*a* or 34*a*. Therefore, the first accelerating/focusing electrode 33 and the second accelerating/focusing electrode 34 form the weaker focusing lenses in the horizontal direction and form the stronger focusing lenses in the vertical direction.

Figure 10B:
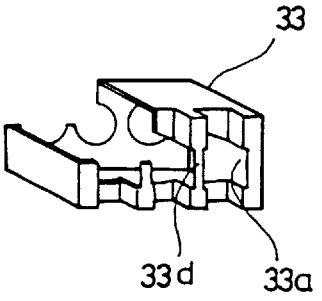
Figure 10C:
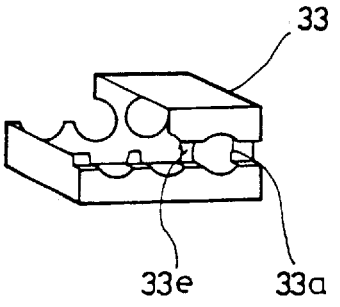

In this case, it is preferred to make the width of each recess in the horizontal in-line direction be smaller than the vertical diameter of each beam passing opening, while it is preferred to make the width of each recess in the direction perpendicular to the in-line direction be smaller than the vertical diameter of each beam passing opening. Turning to FIGS. 10B and 10C, there are shown other embodiments of the first accelerating/focusing electrode 33 of the electron guns of FIG. 9. As shown in FIG. 10B, the first accelerating/focusing electrode, 33 of the electron guns of the third embodiment may be provided with a plurality of partitions 33*d* on one surface thereof, which surface of the electrode 33 is opposed to the second accelerating/focusing electrode 34. The partitions 33*d* protrude from the surface of the electrode 33 between the beam passing openings 33*a* in a direction perpendicular to the horizontal in-line direction. Each partition 33*d* has a width smaller than that of each beam passing opening 33*a*. As shown in FIG. 10C, the first accelerating/focusing electrode 33 of the electron guns of the third embodiment also may be provided with a plurality of depressed partitions 33*e* on one surface thereof, which surface of the electrode 33 is opposed to the second accelerating/focusing electrode 34. The partitions 33*d* are depressed from the surface of the electrode 33 between the beam passing openings 33*a* in a direction perpendicular to the horizontal in-line direction. Each partition 33*d* has a width smaller than that of each beam passing opening 33*a* and opposed sides of each partition 33*d* are depressed into oval-shape.

The back surface of the first accelerating/focusing electrode 33 as well as the back surface of the second accelerating/focusing electrode 34 is formed by composition of arc and straight line, while the front surfaces of the electrodes 33 and 34 are provided with beam passing openings 33*a* and 34*a* respectively.

The operational effect of the above electron guns will be described hereinbelow.

Figure 11A:
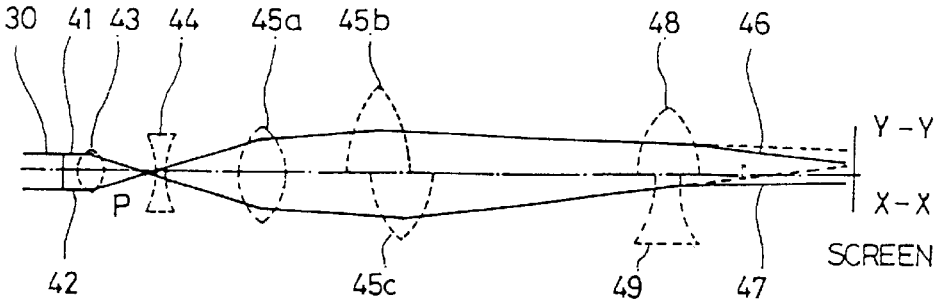

FIG. 11A is a view showing an optical system of the electron guns of the first embodiment of the invention. As shown in this drawing, the horizontal section electron beams 41 and the vertical section electron beams 42, which beams 41 and 42 were emitted from the cathodes 10 in accordance with heating of the heaters of the cathodes 30, form a cross-over point P while they pass through a cathode lens 43. The beams 41 and 42 are equally diffused and converged in the vertical direction and in the horizontal direction by the action of the a pre-focus lens 44 and by the action of a front auxiliary focusing lens 45*a*. At this time, even when the main electrostatic focusing lenses 45*b* and 45*c* carry out their focusing actions on different positions in the vertical direction and in the horizontal direction and the beam forming region of the electron guns is not axially asymmetric, both the over-focus of the electron beams at the edge of the screen caused by the converging magnetic field lens 48 in the vertical direction of the deflection magnetic field and the under-focus of the electron beams at the edge of the screen caused by the diffusing magnetic field lens 49 in the horizontal direction of the deflection magnetic field are remarkably removed. Otherwise stated, the main electrostatic focusing lenses 45*b* and 45*c* are positioned relative to the cathodes 30 in such a manner that the distance between the lens 45*b* of the vertical direction and the cathodes 30 is shorter than that between the lens 45*c* of the horizontal direction and the cathodes 30. Therefore, the vertical electron beams from the front auxiliary focusing lens 45*a* are focused on the center of the main electrostatic focusing lens 45*b* in the vertical direction, so that the focusing action in the vertical direction is weakened. On the other hand, the main electrostatic focusing lens 45*c* of the horizontal direction is positioned far from the cathodes 30, the electron beams from the front auxiliary focusing lens 45*a* are nearly focused on the outermost edge of the main electrostatic focusing lens 45*b* of the vertical direction, so that the focusing action in the horizontal direction is strengthened.

Figure 11B:
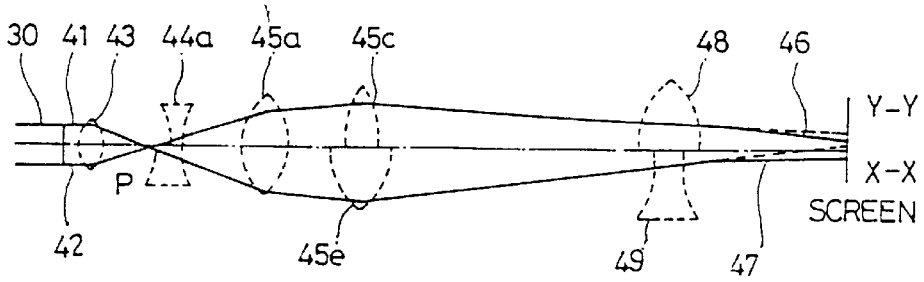

FIG. 11B is a view showing an optical system of the electron guns of the second embodiment of the invention. As shown in this drawing, the horizontal section electron beams 41 and the vertical section electron beams 42 emitted from the cathodes 10 form the cross-over point P in the same manner as described for the optical system of FIG. 11A. The electron beams form horizontal slender electron beams diffused in the horizontal direction rather than the vertical direction by an asymmetric pre-focusing lens 44*a* which strongly diffuses the electron beams in the horizontal direction. At this time, the beam focusing action in the vertical direction is weakened by the main electrostatic focusing lenses 45*d* and 45*e* having different focusing actions in the vertical direction and in the horizontal direction. In addition, the beam focusing action in the horizontal direction is slightly weakened in comparison with the prior embodiment.

Figure 6A:
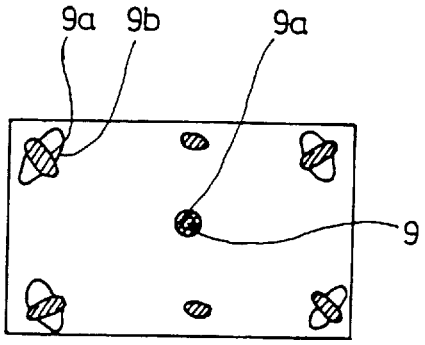
FIG.6A CONVENTIONAL ART
FIG. 6A shows shapes of beam spots formed on all over the screen by electron guns having circular axial asymmetric beam passing openings.
Figure 6B:
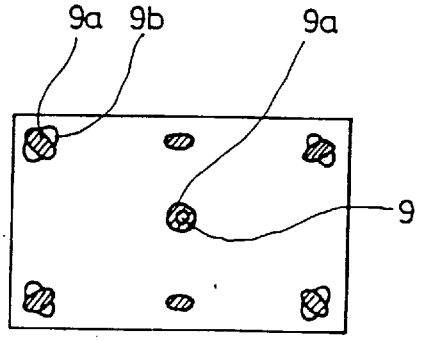
FIG.6B CONVENTIONAL ART
FIG. 6B shows shapes of beam spots formed on all over the screen by electron guns having horizontal slender non-circular beam passing openings in the beam forming region.

Therefore, the electron guns of FIG. 11B reduce the vertical slenderness of the beam spots formed on the center of the screen in comparison with the prior embodiment and removes the hollow parts 9*b* (see FIG. 6) of low electron density formed above and below the core part 9*a* of each beam spot formed on the edge of the screen are removed, thus to improve the resolution of the color picture tube.

Figure 5A:
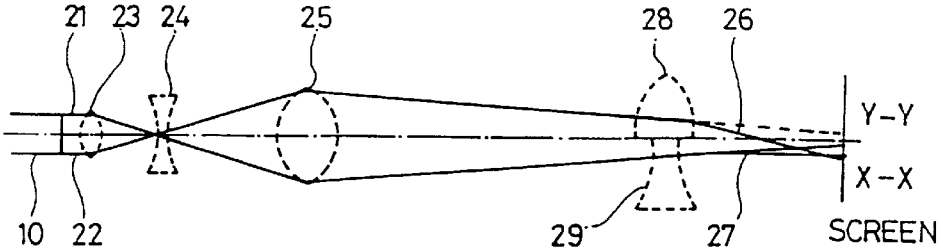
FIG.5A CONVENTIONAL ART
FIGS. 5A and 5B are views showing optical systems representing formation of picture of the electron beams on a screen of the color picture tube having the typical electron guns.
Figure 5B:
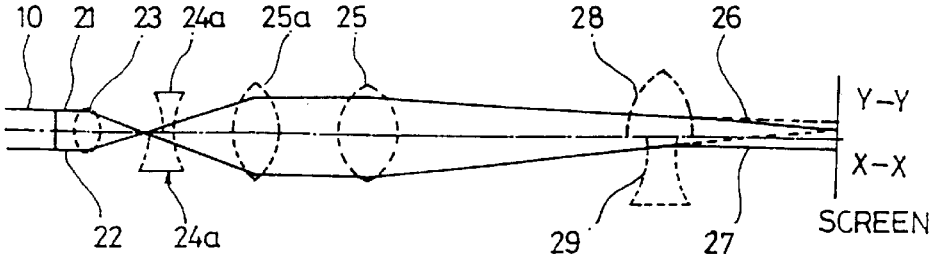
FIG.5B CONVENTIONAL ART
Figure 11C:
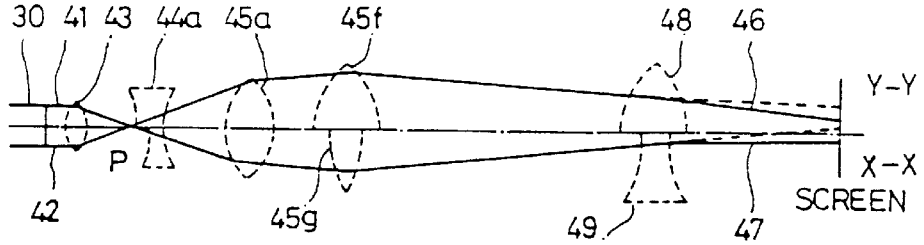

FIG. 11C is a view showing an optical system of the electron guns of the third embodiment of the invention. As shown in this drawing, the horizontal section electron beams 41 and the vertical section electron beams 42 emitted from the cathodes 10 form the cross-over point P in the same manner as described for the optical system of FIG. 11A. The electron beams form vertical slender electron beams diffused in the vertical direction rather than in the horizontal direction by the asymmetric pre-focusing lens 44*a* which strongly diffuses the electron beams in the vertical direction. The vertical slender electron beams are formed by the asymmetric pre-focusing lens as a result of forming, in the vertical direction, a main electrostatic focusing lens 45*f* having the focusing strength nearly equal to that of the prior embodiment and as a result of forming, in the horizontal direction, a main electrostatic focusing lens 45*g* having a weak focusing strength. Therefore, the electron guns of the third embodiment compensate for the converging action of the converging magnetic field lens 48 as well as for the diffusing action of the diffusing magnetic field lens 49, thus to improve the resolution of the color picture tube. Reference numerals 46 and 47 represent, respectively, the same elements/features as reference numerals 26 and 27 in prior art FIGS. 5A and 5B.

Figure 12:
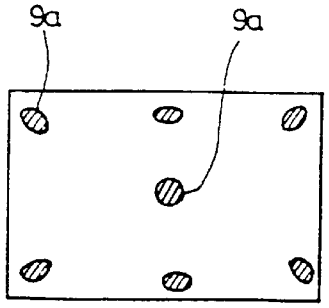
FIG. 12 is a view showing beam spots formed on all over the screen of a color picture tube having electron guns of the present invention.

FIG. 12 shows beam spots formed on all over the screen of a color picture tube having electron guns of the present invention. As shown in this drawing, the vertical slenderness of the beam spot formed on the center of the screen is reduced and the hollow parts 9*b* of low electron density formed above and below the core part 9*a* of each beam spot formed on the edge of the screen are nearly removed, so that the resolution of the color picture tube is remarkably improved.

As described above, the beam passing openings of first and second accelerating/focusing electrodes constituting the main electrostatic focusing lenses of electron guns for color picture tube of the present invention are projected or depressed in specified directions, thus to let the focusing actions of the main electrostatic focusing lenses in the vertical direction and in the horizontal direction not only be carried out at different positions but also be differently carried out. Therefore, the electron guns of the present invention reduce the vertical slenderness of the beam spot formed on the center of the screen and nearly remove the hollow parts of low electron density formed above and below the core part of each beam spot formed on the edge of the screen, thus to remarkably improve the resolution of the color picture tube.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. Electron guns for a color picture tube comprising three electron beam sources for emitting in parallel electron beams to a Phosphor screen of the color picture tube, and main lenses for focusing the electron beams on the phosphor screen, wherein the improvement comprises:

main electrostatic focusing lens including a first accelerating/focusing electrode and a second accelerating/focusing electrode which protrude and recede around beam passing openings, whereby said first accelerating/focusing electrode and said second accelerating/focusing electrode carry out a vertical focusing action and a horizontal focusing action at different positions; wherein said first accelerating/focusing electrode is provided with a plurality of regularly spaced projections on one surface thereof, said projections being arranged in a horizontal in-line direction and each having a width smaller than that of each beam passing opening of the first accelerating/focusing electrode and protruding at its center but flattening at its top and bottom portions; and said second accelerating/focusing electrode is provided with a plurality of regularly spaced receiving recesses on one surface thereof, said recesses being arranged in the horizontal in-line direction and each having a width smaller than that of each beam passing opening of the second accelerating/focusing electrode and being depressed at its center but flattening at its top and bottom portions.

2. Electron guns for a color picture tube comprising three electron beam sources for emitting in parallel electron beams to a phosphor screen of the color picture tube, and main lenses for focusing the electron beams on the phosphor screen, wherein the improvement comprises:

main electrostatic focusing lens including a first accelerating/focusing electrode and a second accelerating/focusing electrode which protrude and recede around beam passing openings, whereby said first accelerating/focusing electrode and said second accelerating/focusing electrode carry out a vertical focusing action and a horizontal focusing action at different positions; wherein said first accelerating/focusing electrode is provided with a plurality of regularly spaced projections on one surface thereof, said projections being arranged in a horizontal in-line direction and each having a width smaller than of each beam passing opening of the first accelerating/focusing electrode and protruding at its center but flattening at its top and bottom portions; and said second accelerating/focusing electrode is provided with a plurality of partitions on one surface thereof between beam passing openings, each of said partitions protruding from the one surface in a direction perpendicular to the horizontal in-line direction and having a width smaller than that of each of said beam passing openings of the second accelerating/focusing electrode.

3. Electron guns for a color picture tube comprising three electron beam sources for emitting in parallel electron beams to a phosphor screen of the color picture tube, and main lenses for focusing the electron beams on the phosphor screen, wherein the improvement comprises:

main electrostatic focusing lens including a first accelerating/focusing electrode and a second accelerating/focusing electrode, said first accelerating/focusing electrode and said second accelerating/focusing electrode carrying out a vertical focusing action and a horizontal focusing action at different positions, wherein said first accelerating/focusing electrode is provided with a plurality of regularly spaced projections on one surface thereof, said projections being arranged in a horizontal in-line direction and each having a width smaller than that of each beam passing opening of the first accelerating/focusing electrode and protruding at its center but flattening at its top and bottom portions; and said second accelerating/focusing electrode is provided with a plurality of regularly spaced receiving recesses on one surface thereof, said recesses being arranged in the horizontal in-line direction and each having a width smaller than that of each beam passing opening of the second accelerating/focusing electrode and being depressed at its center but flattening at its top and bottom portions.

4. Electron guns for a color picture tube comprising three electron beam sources for emitting in parallel electron beams to a phosphor screen of the color picture tube, and main lenses for focusing the electron beams on the phosphor screen, wherein the improvement comprises:

main electrostatic focusing lens including a first accelerating/focusing electrode and a second accelerating/focusing electrode, said first accelerating/focusing electrode and said second accelerating/focusing electrode carrying out a vertical focusing action and a horizontal focusing action at different positions, wherein said first accelerating/focusing electrode is provided with a plurality of regularly spaced projections on one surface thereof, said projections being arranged in a horizontal in-line direction and each having a width smaller than that of each beam passing opening of the first accelerating/focusing electrode and protruding at its center but flattening at its top and bottom portions; and said second accelerating/focusing electrode is provided with a plurality of partitions on one surface thereof between beam passing openings, each of said partitions protruding from the one surface in a direction perpendicular to the horizontal in-line direction and having a width smaller than that of each of said beam passing openings of the second accelerating/focusing electrode.

* * * * *